US006474026B1

(12) United States Patent
McGarity

(10) Patent No.: US 6,474,026 B1
(45) Date of Patent: Nov. 5, 2002

(54) MAUSOLEUM

(76) Inventor: Allan E. McGarity, 800 Brookside Dr., Elberton, GA (US) 30635

( * ) Notice: Subject to any disclaimer, the term of this patent is extended or adjusted under 35 U.S.C. 154(b) by 0 days.

(21) Appl. No.: 09/898,240

(22) Filed: Jul. 3, 2001

(51) Int. Cl.[7] ..... E04M 13/00

(52) U.S. Cl. ..... 52/134; 52/128; 52/136; 52/142; 52/204.2

(58) Field of Search ..... 52/128, 134, 136, 52/140, 142, 204.2, 608

(56) References Cited

U.S. PATENT DOCUMENTS

| | | | | | |
|---|---|---|---|---|---|
| 716,068 | A | * | 12/1902 | Lester | 52/134 |
| 964,184 | A | * | 7/1910 | Pugh | 52/136 |
| 1,261,125 | A | * | 4/1918 | Havens | 52/11 |
| 1,331,172 | A | * | 2/1920 | Viquesney | 52/124.2 |
| 1,342,812 | A | * | 6/1920 | Hughes et al. | 454/173 |
| 3,455,072 | A | * | 7/1969 | Ferris | 52/134 |
| 3,958,378 | A | * | 5/1976 | Omeechevarria | 52/136 |
| 3,983,667 | A | * | 10/1976 | Zwick | 220/378 |
| 6,250,025 | B1 | * | 6/2001 | Darby | 52/137 |

FOREIGN PATENT DOCUMENTS

| | | | | | |
|---|---|---|---|---|---|
| AU | 9733177 | A | * | 2/1986 | E04H/13/00 |
| FR | 435422 | | * | 12/1911 | 52/134 |
| FR | 521101 | | * | 7/1921 | 52/136 |

* cited by examiner

*Primary Examiner*—Yvonne M. Horter
*Assistant Examiner*—Brian E. Glessner
(74) *Attorney, Agent, or Firm*—McNair Law Firm, P.A.

(57) ABSTRACT

A mausoleum, formed of stone pieces having a plurality of crypts. The mausoleum is formed of a plurality of vertical walls each formed of a stone piece engaged at selected ends to form vertically extending seams. A roof, comprising a plurality of elongated stone pieces arranged in pyramid fashion longitudinally of the mausoleum, is supported by upper edges of certain of the vertical walls. A header extends transversely of the front of the mausoleum. The header is supported by the upper edges of other of the vertical walls and the forward end of the roof pieces. This arrangement provides that the roof and the header cover upper portions of all vertically extending seams while the header provides a homogeneous, pleasing face to the structure.

15 Claims, 3 Drawing Sheets

Fig. 1
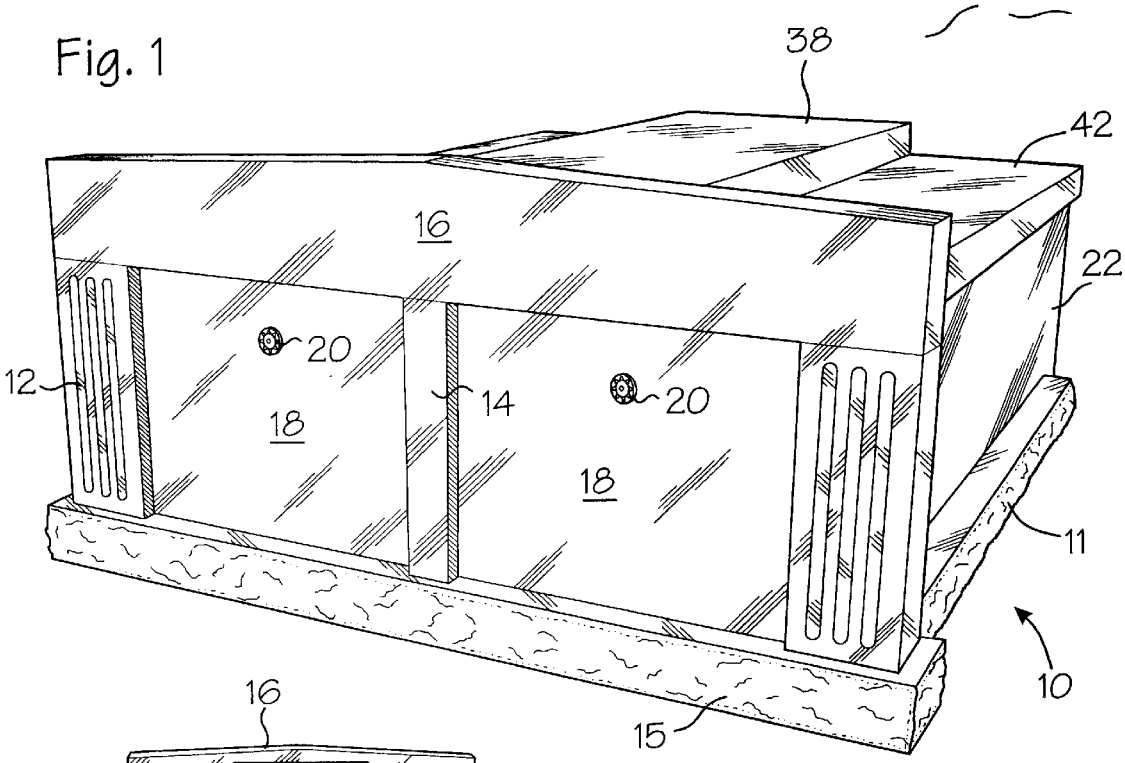
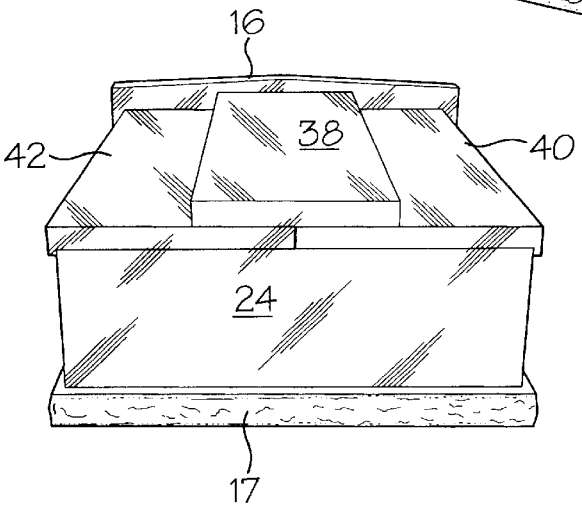
Fig. 2
Fig. 3
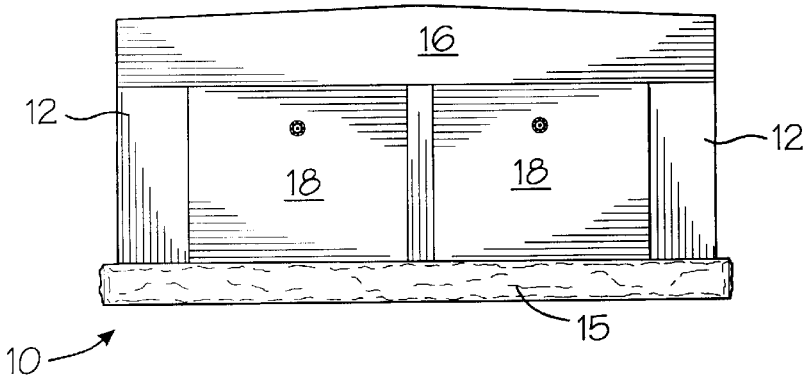

MAUSOLEUM

BACKGROUND OF THE INVENTION

The instant invention is directed to a mausoleum formed of stone. Preferably the mausoleum of the invention is a multi-compartment unit formed with two side-by-side compartments or crypts. It is to be understood that mausoleums formed with one crypt, more than two crypts, and crypts on more than one level are within the scope of this invention.

Mausoleums are old in the industry as is illustrated by the U.S. Pat. No. 716,068 to Lester and U.S. Pat. No. 3,455,072 to Ferris. The mausoleum disclosed in the Lester patent is a multi-tier vault having a three piece roof and multi-material walls. It is noted the front edge of the roof presents a plurality of exposed seams. Ferris discloses a mausoleum, which may be single or multi-layered, and is formed of granite. The arrangement discloses using a single granite piece for the top.

The instant invention has for its object providing a mausoleum formed of stone, preferably granite or marble of selected colors.

Another object is a stone mausoleum which presents a pleasing solid appearance while being constructed at a minimum cost.

Another object of the invention is a mausoleum which presents a front with a seamless header which may be etched.

Another object of the invention is a mausoleum with no uncovered vertical seams.

Another object of the invention is a mausoleum which presents a front with the appearance of a one piece roof.

Another object of the invention is a mausoleum with a header across the front whose back side is formed with a stepped groove which encapsulates the front ends of the roof pieces.

SUMMARY OF THE INVENTION

The above objectives are accomplished according to the present invention by a multi-unit mausoleum formed of a plurality of stone pieces. The mausoleum includes a base which supports a plurality of upstanding walls which form opposed the sides and a rear side. A roof is supported by the upstanding walls. A front, which includes a portion of the base, at least one end portion of selected of the upstanding walls, and a continuous header. The header extends over and is supported by upper portions of the vertical walls forming a plurality of openings into the crypts. A removable closure is provided for each opening.

The header includes a rear side having a lateral recess formed along its lower portion. The recess is configured to receive the end portion of the roof.

The roof comprises a plurality of slabs arranged in step form. The recess is also step shaped to conform with the end contour of the roof.

The stone pieces may be of granite or marble. They may present a polished exposed surface, a combination polished and cut exposed surface, or it may simply be a cut surface. The base, rear, and sides are preferably each formed of a single piece of stone.

The header is also formed of a single piece of stone generally rectangular shaped with a peaked upper surface and a planar lower surface. Its front may be engraved or it may be plain.

A mausoleum formed of stone pieces having a plurality of compartments comprising a base supporting a plurality of vertical wall pieces of a selected length in parallel spaced position and a roof comprising a plurality of elongated rectangular shaped pieces of a length slightly greater than said length of said wall pieces. At least certain roof pieces are supported adjacent opposed longitudinal edges by upper edges of the vertical wall pieces.

A header is positioned atop an end portion of at least one of the upstanding wall pieces and end portions of the roof pieces. The header forms an upper portion of the openings to the compartments.

A removable closure piece is positioned beneath the header closing the opening.

The header is generally or rectangular shape and includes a lateral recess along its lower rear surface. The recess is shaped and sized to matingly receive the front end portions of the roof.

A mausoleum, formed of stone pieces in which the vertically extending seams formed by a plurality of vertical stone walls engaging at selected ends. The roof which comprises a plurality of stone pieces arranged in pyramid fashion longitudinally of the mausoleum also forms a vertical seam. The roof stone pieces are supported by upper edges of certain of the vertical walls. A header extends transversely of the mausoleum forming a portion of the front end. The header is supported by upper edges of other of the vertical walls and a forward end of the roof. So arranged the roof and the header cover upper portions of the vertically extending seams.

The header includes a longitudinal groove along its lower rear surface which is shaped to matingly receive the forward end of the roof. There are opposed pairs of vertical grooves formed adjacent the openings in the front end of the mausoleum. These grooves are adapted to receive and maintain edge portions of a cover plate which closes the openings. There is provided a pair of vertical front walls arranged perpendicular of outermost of the certain vertical walls and upper ends of the other of the vertical walls which support the header adjacent its opposed ends.

DESCRIPTION OF THE DRAWINGS

The invention will be more readily understood from a reading of the following specification and by reference to the accompanying drawings forming a part thereof, wherein an example of the invention is shown and wherein:

FIG. 1 is a front perspective view of the mausoleum of the invention;

FIG. 2 is a rear perspective view;

FIG. 3 is a plane front view;

DESCRIPTION OF A PREFERRED EMBODIMENT

Referring now in more detail to the drawings, the invention will now be described in more detail.

Figure 6:
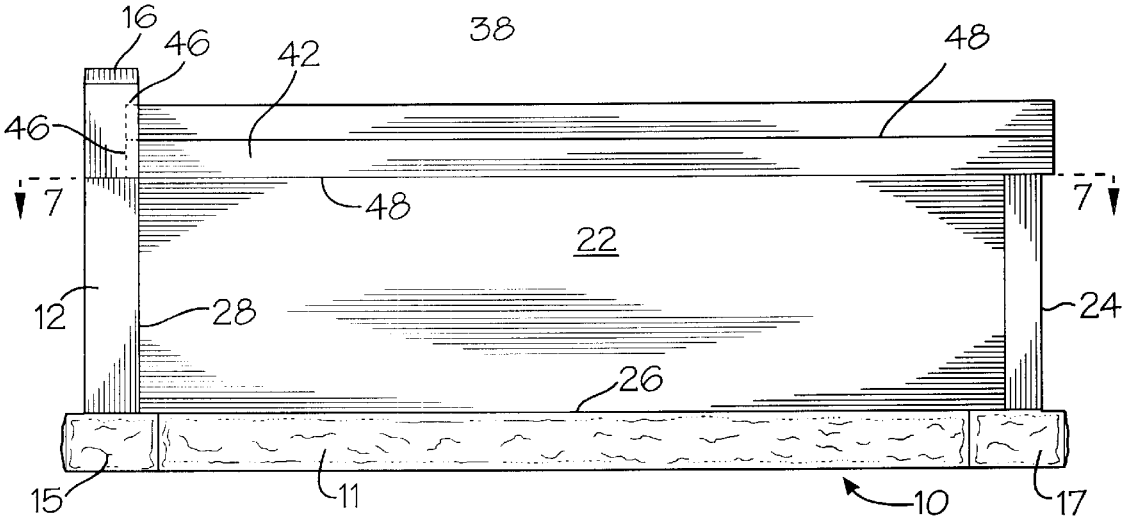
FIG. 6 is a plane side view.
Figure 7:
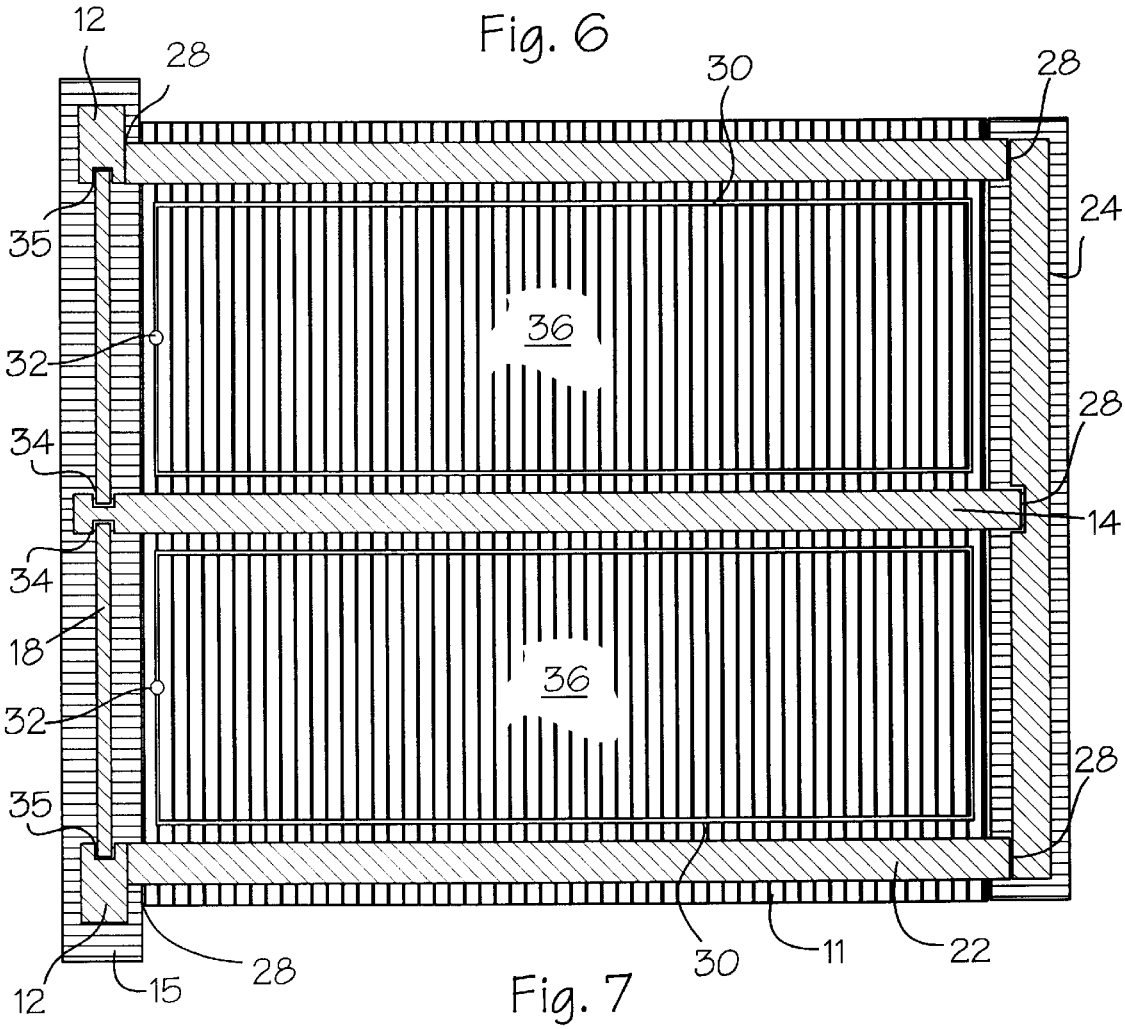
FIG. 7 is a cutaway top view taken along lines 7—7 of FIG. 6.

FIGS. 1 and 2 show, in perspective front side views, the mausoleum of the invention. The front includes base 10, vertical outer front walls 12, an edge of vertical inner wall 14 and header 16. A pair of closure members 18 fill the opening created between base 10, walls 12, 14 and header 16 which opens into crypt 36 of the mausoleum, best seen in FIG. 7. Bronze rosettes 20 may be secured to the outer surface of closure members 18. As best shown in FIGS. 6 and 7, behind each outer wall 12 is located the forward end of a vertical side wall 22. The side walls extend parallel with and are spaced from vertical inner wall 14. A rear wall 24 extends transversely of walls 14 and 22 and is positioned in engagement with end portions thereof.

All vertical walls are mounted on base 10. Horizontal seams 26 are formed between base 10 and the vertical walls while vertical seams 28 are formed between engaging end portions of all vertical walls. Each seam includes some form of an adherent such as a cement or synthetic caulking which secures the engaging portions together.

Drain grooves 30 may be cut in the upper surface of base 10. A drain hole 32 which communicates with groove 30 may be cut through base 10 at a selected point. This arrangement allows any condensation which may form within the chamber to drain out.

FIG. 7 shows vertical grooves 34 cut in opposed positions in the side faces and adjacent the end of inner wall 14 and opposing vertical grooves 35 cut in edge portions of vertical walls 12. Grooves 34, 35 act to removably retain inserts 18 in position prior to remains being placed in chamber or crypt 36 of the mausoleum. Upon the crypt being occupied, the closure is re-positioned in grooves 34 and secured in position with a selected sealer or concrete.

Top or roof pieces 40, 42 are positioned with opposed of their longitudinal edges on the upper ends of vertical walls 14 and 22. Opposed inner edges of pieces 40, 42 are in engagement forming a vertical seam 44. The outer and rear edges of top pieces 40, 42 are supported by the upper edges of vertical walls 22, 24 and may be flush with or extend slightly beyond the vertical outer surface of these walls. Forward ends 46 of top pieces 40, 42 are positioned just beyond of the forward ends of outer vertical walls 22 and just short of the end of vertical wall 14 covering vertical seams 28. The third top piece 38 is positioned over top pieces 40, 42 and seam 44 forming an upper surface which is step or pyramid shaped.

Horizontal seams 48 are formed between top pieces 38, 40, 42 and top pieces 40, 42 and the upper edges of vertical walls 22, 24.

Figure 4:
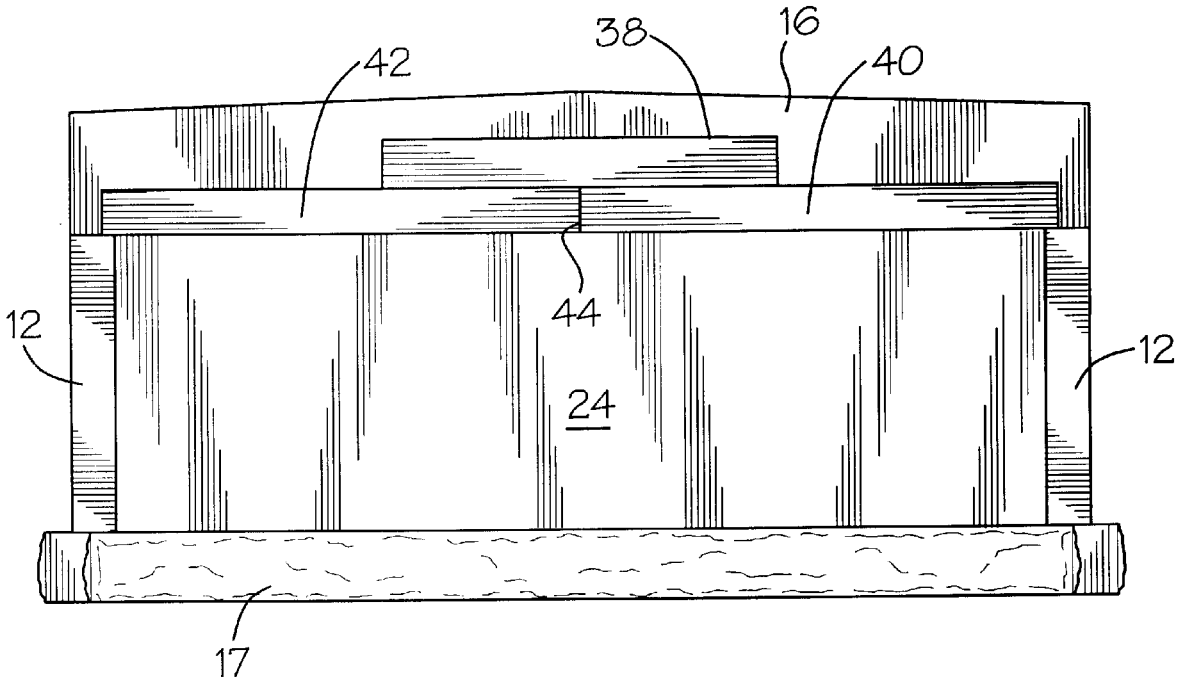
FIG. 4 is a plane rear view.
Figure 5:
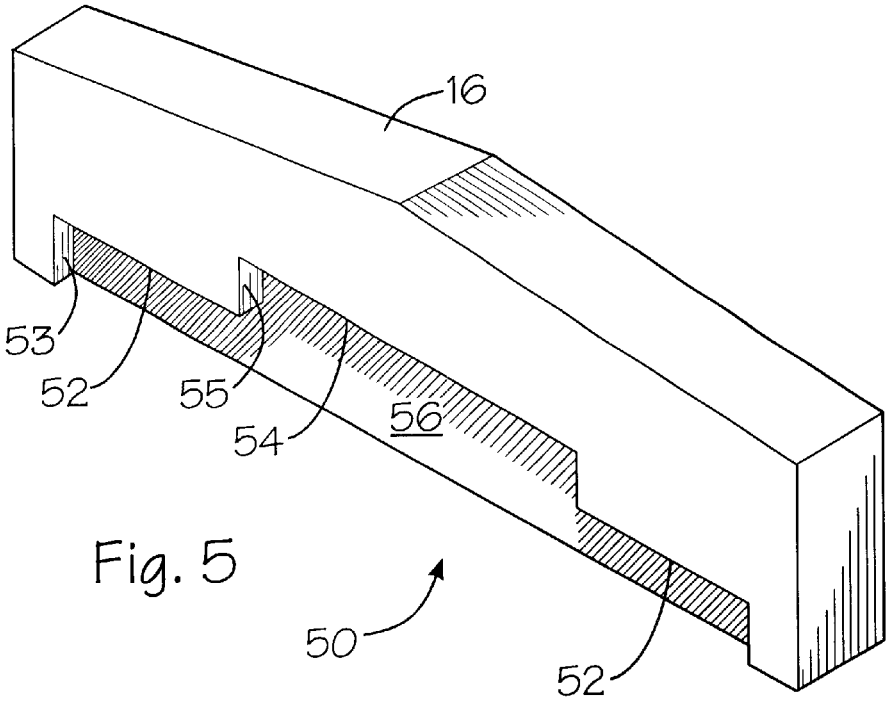
FIG. 5 is a rear perspective view of the header piece.

Header 16 as best seen in FIG. 5 is formed with a horizontal recess 50 formed along its rear and lower surface. Recess 50 is step shaped to include lower upper surfaces 52 which are about 4.5" above the base and raised upper surface 54 which is about 9" above the header base. Vertical walls 53, 55 form the outer extremities of the recess. Recess 50 is cut about 2" deep and to a length of about 6', 10.5". These dimensions are such that the recess fittingly receives forward end portions 46 of top pieces 38, 40, 42 against inner wall 56. A suitable adherent is applied along the vertical and horizontal engaging surfaces when the header is in position.

Again, referring to FIGS. 1 and 6, header 16 is positioned with its lower horizontal surface supported at its outer ends by the upper surfaces of front walls 12 and the forward upper end of inner wall 14. It is preferred that the face of header 16 be located flush with the end face portion of inner wall 14 and front walls 12, however it may be located slightly forward thereof to form a slight overhang. In this position header 16 acts to cover the vertical seam 46 at the front, top, or roof pieces 38, 40, 42 of the mausoleum. Header 16 acts to stabilize vertical walls 12 and 14 as well as top pieces 38, 40, 42.

Preferably, the header is generally rectangular at about 7', 4" in width, 6" in length, and 1', 2" in height. Preferably, there is a slight peak formed along its upper surface with the edge portions being only about 1' in height and the center area being about 1', 2" in height.

Base 10, as best seen in FIGS. 6 and 7, is preferably a plurality of pieces with a large main piece 11 which is about 6" thick, about 7', 2" in length, and 6', 8" wide. End pieces 15, 17 which are about 10" long and of equal thickness with the base piece are provided with rear piece 17 being with the base piece of equal width. The front piece 15 is about 7', 8" in width providing a wing on each side to assist in the support of vertical walls 12. It is preferred that a ledge of about 2" be provided on the upper surface of the base between the vertical walls all the way around. It is noted that the base could be one piece.

Chambers or crypts 36 are formed to about 2', 8" in width and 7', 6" in length. The mausoleum may comprise a single crypt, two crypts as shown, or more than two crypts. It may be built on a single level or a plurality of levels.

It is preferred that all forming pieces be formed of granite or marble, however, the mausoleum may comprise a combination of pieces with certain walls or portions of the base being cut concrete. It is preferred that all outer surfaces, except side faces of the base, be polished. In all instances the front should be formed of stone.

While a preferred embodiment of the invention has been described using specific terms, such description is for illustrative purposes only, and it is to be understood that changes and variations may be made without departing from the spirit or scope of the following claims.

What is claimed is:

1. A multi-crypt mausoleum formed of a plurality of stone pieces comprising:

a base;

a plurality of upstanding walls including opposed sides and a rear;

a roof supported by said upstanding walls forming a plurality of crypts;

a front including openings into said crypts comprising a portion of said base, at least one end of a selected of said upstanding walls, and a continuous header, said header including a rear side having a lateral recess formed along its lower portion and extending over and being supported by said at least one end forming said openings, said recess being configured to receive an end of said roof; and, a removable closure for each said opening.

2. The mausoleum of claim 1 wherein said roof comprises a plurality of slabs arranged in step form.

3. The mausoleum of claim 2 wherein said recess is step shaped to conform with the end contour of said roof.

4. The mausoleum of claim 1 wherein said stone pieces comprises one of granite and marble.

5. The mausoleum of claim 1 wherein said stone pieces have a polished exposed surface.

6. The mausoleum of claim 1 wherein a single piece of said stone pieces form each of said opposed sides and said rear.

7. The mausoleum of claim 1 wherein a plurality of pieces of said stone pieces forms said base.

8. The mausoleum of claim 1 wherein said header comprises a single piece of stone with a peaked upper surface and a planar lower surface.

9. The mausoleum of claim 1 wherein said recess extends into said header a distance equal to about ⅓ of its length.

10. A mausoleum formed of stone pieces having a plurality of crypts comprising:

a base supporting a plurality of vertical wall pieces of a selected length in parallel spaced position;

a roof comprising a plurality of elongated rectangular shaped pieces of a length slightly greater than said length of said wall pieces, at least certain of said roof pieces being supported adjacent opposed longitudinal edges by upper edges of said vertical wall pieces;

a header positioned atop an end portion of at least one of said vertical wall pieces and end portions of said roof pieces, said header forming an upper portion of openings into said crypts; and, removable closure pieces positioned beneath said header closing said openings.

11. The mausoleum of claim 10 wherein said header is generally of rectangular shape and includes a lateral recess along its lower rear surface, said recess being shaped and sized to matingly receive said end portions of said roof.

12. A mausoleum, formed of stone pieces, having a plurality of crypts comprising:

a plurality of vertical walls each formed of a stone piece engaging at selected ends forming vertically extending seams;

a roof comprised of a plurality of pieces arranged in pyramid fashion longitudinally of said mausoleum and supported by upper edges of certain of said vertical walls;

a header extending transversely of said mausoleum adjacent a front end thereof, said header being supported by upper edges of other of said vertical walls and a forward end of said roof; wherein, said roof and said header cover upper portions of said vertically extending seams.

13. The mausoleum of claim 12 wherein said header includes a longitudinal groove along its lower rear surface, said groove being shaped to receive said forward end of said roof.

14. The mausoleum of claim 12 including opposed pairs of vertical grooves formed adjacent openings in said mausoleum front end, said grooves being adapted to receive and maintain edge portions of a cover plate which closes said openings.

15. The mausoleum of claim 12 wherein said plurality of vertical walls include at least a pair of vertical front walls arranged perpendicular of outermost of said certain vertical walls and upper ends of said vertical front walls support said header adjacent its opposed ends.

* * * * *